United States Patent [19]

Willmann et al.

[11] 3,974,362

[45] Aug. 10, 1976

[54] FLEXITIME RECORDER

[75] Inventors: Erich Willmann, Zell (Neckar); Günter Trischler, Plochingen (Neckar), both of Germany

[73] Assignee: Simplex Time Recorder Company, Gardner, Mass.

[22] Filed: July 23, 1974

[21] Appl. No.: 491,068

[30] Foreign Application Priority Data

July 25, 1973 Germany ..... 2337712

[52] U.S. Cl. ..... 235/92 T; 235/92 AC; 235/92 R; 324/186

[51] Int. Cl.[2] ..... G06M 3/14

[58] Field of Search ..... 235/92 T, 92 AC; 346/20; 58/24 A; 324/186

[56] References Cited

UNITED STATES PATENTS

| | | | |
|---|---|---|---|
| 3,221,150 | 11/1965 | Goodwin | 235/92 AC |
| 3,593,008 | 7/1971 | DeWitt et al. | 235/92 T |
| 3,641,321 | 2/1972 | Tonne | 235/92 AC |
| 3,665,165 | 5/1972 | Strandberg | 235/92 T |

*Primary Examiner*—Joseph M. Thesz
*Attorney, Agent, or Firm*—Shenier & O'Connor

[57] ABSTRACT

The flexitime recorder has a plurality of time store counters which are actuated by timing pulses transmitted by a generator, and there is a plurality of switches which are actuable by persons whose time is being recorded, in order to control the counters in accordance with their in-time. The flexitime recorder has a programming device for preventing the counters storing in-time outside predetermined periods including a daily set working time, and there is a registering device controlled by the timing pulses for registering the set working time each day.

8 Claims, 5 Drawing Figures

FLEXITIME RECORDER

BACKGROUND OF THE INVENTION

The invention relates to flexitime recorder of the kind having timing pulse generating means and time stores constructed as counting means which are connected to the time pulse generating means and can be individually switched on and off at the beginning and end of the "in-time" of the worker with whom they are associated.

When using the flexitime method, it is advantageous for personnel if they are able to obtain daily information regarding the difference between working time actually performed and a set or specified working time. In a large flexitime recording system with a central data processing unit, it is already possible for the so-called flexitime balance, i.e. the difference between the time actually worked and the specified time, to be recorded and stored in the central unit for each worker so that each worker is able to call up this actually measured flexitime balance at the terminals of the system for direct reading from a display unit. However, this complexity cannot be justified in flexitime recorders of the kind referred to above, which are used in smaller plants, so that it is common practice to prepare lists which contain the totalised amount of specified working time which has accumulated for each working day; the worker can obtain his flexitime balance every day by comparing the time actually worked and displayed by a counter with the set working time which can be obtained from the list.

THE INVENTION

According to the invention, the flexitime recorder is controlled by a timing pulse generator, and registering means in association with programming means register the set working time; the working days or non-working days can be stored in the programming means, and the programming means can be controlled by the timing pulse generator.

The flexitime recorder of the invention is suitable for smaller plants, but each worker can determine his flexitime balance daily without the need for preparing lists or the like for the accrued set working time.

Different embodiments of the invention are possible. In the simplest embodiment, the flexitime recorder is provided with a set time counting means for recording the set working time, the set time counting means being adjacent the time store counting means and the latter having display means indicating the in-time; circuit means such as a gate, controlled by the programming means in accordance with the set time, and preferably also working and non-working days, can connect the set time counting means to the timing pulse generator. The set time counting means totalises the set time at the rhythm of the timing pulses. It would also be feasible to index the set time counting means through one step by the amount of set time on each working day. However, in this case, the worker would still have to calculate his flexitime balance.

There is no need to calculate the flexitime balance in a second embodiment of the invention. In this embodiment, the time store counting means are capable of incremental and decremental operation, and the programming means comprises means for storing at the earliest permitted start time, the latest permitted finish time, any break(s) and the daily set working time, and preferably also the working days and non-working days, the programming means also comprising controlling means for operating in association with the worker-actuated switch means such that when, between the earliest start time and the latest finish time, a switch means is actuated to register in-time, the respective time store counting means neither increases nor decreases during the set time and increases outside the set time, when, between the earliest start time and the latest finish time, a switch means is not actuated to register in-time, the respective time store counting means decreases during the set time and neither increases nor decreases outside the set time, and before the earliest start time and after the latest finish time and during any break(s), whether a switch means is actuated or not, the respective time store counting means neither increases nor decreases.

The time store counting means therefore display the flexitime balances directly. Moreover, this embodiment of the invention offers the advantage of requiring the counting means to count far less and far less frequently because they do not initially add the "in-time" and then subtract the set working time from their stored contents but instead do not count at all if the worker concerned is present during the set working time period. Wear and the frequency of failure of the counting means can thus be substantially reduced.

BRIEF DESCRIPTION OF THE DRAWINGS

Two preferred embodiments of the invention are now described, by way of example, with reference to the accompanying drawings, in which:

FIG. 2(*b*) illustrates an example of a week's program used in the control system of the flexitime recorder;

FIG. 2(*c*) illustrates an example of a set-time program used in the control system of the flexitime recorder;

DETAILED DESCRIPTION OF FIRST EMBODIMENT

Figure 1:
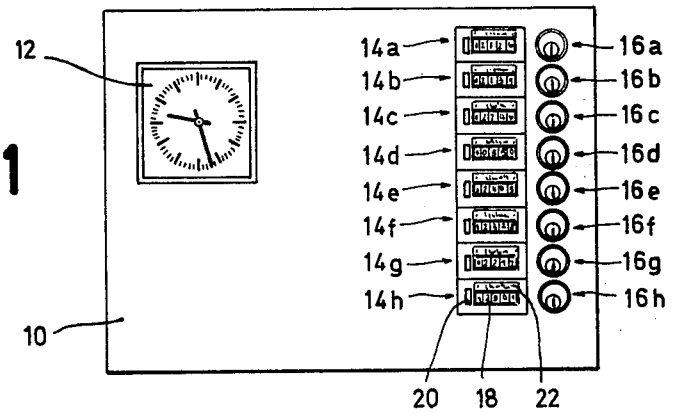
FIG. 1 is a front view of a flexitime recorder according to the invention.

A clock 12 which functions as a display, a plurality of counting means in the form of time store counters 14*a*, 14*b* . . . and a like number of lock switches 16*a*, 16*b* . . . are inserted into a front panel 10 of the flexitime recorder illustrated in FIG. 1, each counter being associated with a respective lock switch. The lock switches are key controlled switches each having two contacts as is explained below. Each counter is provided with a roller counter mechanism 18, for example a four-digit mechanism, a resetting button 20 for the roller counting mechanism and a plate 22 for the consecutive numbering of the counters and inscription with the name of the worker concerned.

Figure 2:
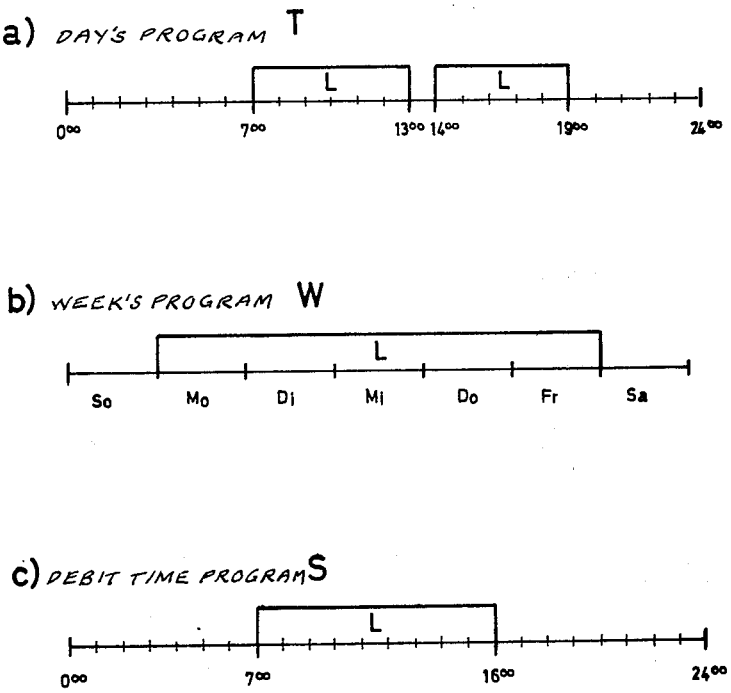
FIG. 2(*a*) illustrates an example of a day's time program used in the control system of the flexitime recorder.

FIG. 2 shows different programs which are are to be stored and processed in a programming unit of the flexitime recorder; processing will be described by reference to FIG. 3.

FIG. 2*a* shows a day or 24 hour program T over a time scale which extends from zero to 24 hours: the program has two states L and O (conducting and non-conducting), the state L remaining operative from the earliest start time to the latest finish time and being interrupted during breaks. In the example illustrated, the earliest start time is set at 0700 hours, a single break, namely the mid-day break, is provided between 1300 and 1400 hours and the latest finish time is set at 1900 hours.

FIG. 2*b* shows a week program W, covering the days of the week from Sunday to Saturday. In the illustrated example, there is no holiday in the week so that for example the week program from Monday to Friday inclusive has the L (conductive) state and on Saturday and Sunday has the O (non-conductive) state.

Finally, FIG. 2*c* shows the set time program, which also has the states L and O, the L state prevailing during a period of time which corresponds to the daily set working time, where appropriate with the addition of any breaks, and it must occur between the earliest working start time and the latest working finish time. In the illustrated example, the state L of the set time program starts at the earliest start time; since the daily set working time is 8 hours and the mid-day break one hour, the L state of the set time program will terminate in the afternoon at 1600 hours, i.e. the state is maintained for 9 hours.

Figure 3:
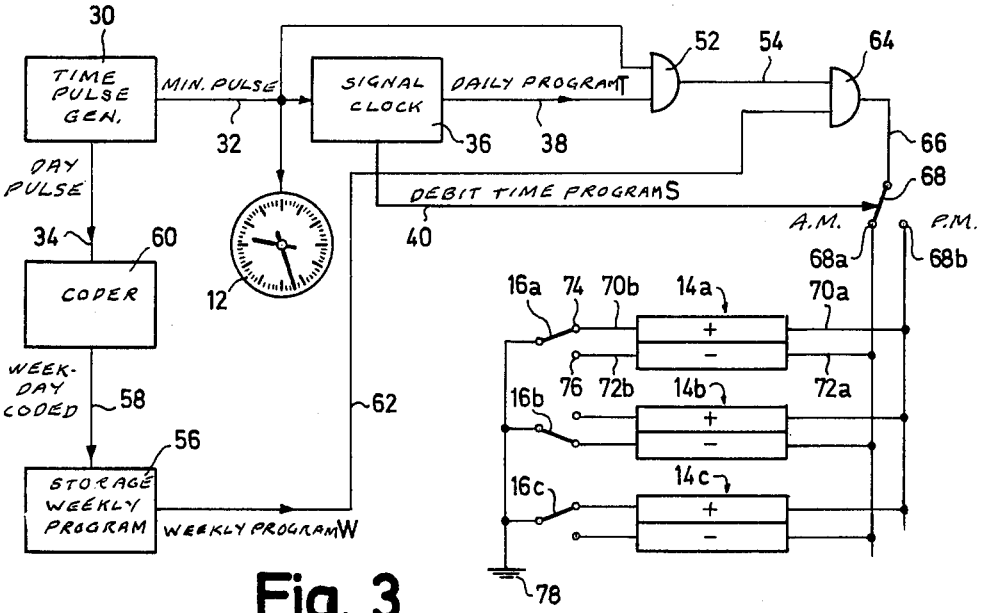
FIG. 3 is a block diagram of a first preferred embodiment of the flexitime recorder according to the invention.

According to the block circuit diagram of FIG. 3, the flexitime recorder has a timing pulse generator 30 which may be a crystal-controlled clock generator. This clock generator transmits one pulse per minute, a so-called minute pulse, to a conductor 32 and transmits one pulse in 24 hours, referred to below as a day pulse, to a conductor 34. The timing pulse generator 30 may contain a frequency divider network (not shown) which is connected downstream of a crystal-controlled oscillator circuit (not shown). The minute pulse is tapped off from the output of the frequency divider circuit and the day pulse is tapped off from the output of one of the divider stages of the frequency divider circuit.

Figure 4:
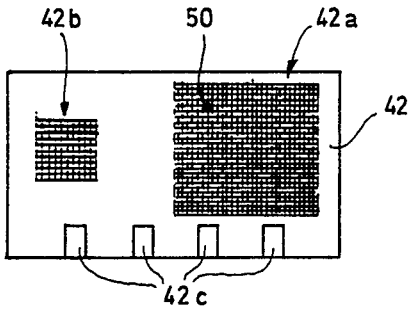
FIG. 4 illustrates a program store for the flexitime recorder of FIG. 3, in the form of a plug-in circuit board.

The conductor 32 extends to the input of a programming unit 36, which can be loosely termed a so-called signal clock and which forms part of the programming means of the flexitime recorder. The unit 36 has two outputs in the form of conductors 38 and 40, the day program T (see FIG. 3(*a*)) being tapped off along the conductor 38 and the set time program S (See FIG. 2(*c*)) being tapped off along the conductor 40. To generate the programs, the programming unit 36 contains one or more preferably interchangeable program stores, taking the form of a circuit board 42 (see FIG. 4) in one preferred example. The circuit board 42 has programming medium in the form of a conductor matrix 42*a* for the day program T and a further conductor matrix 42*b* for the set time program S, terminals 42*c* of the circuit board enabling the programs to be scanned in the unit 37 for the purpose of read out. The conductor matrix 42*a* for the day program can incorporate 24 columns and 60 lines or 60 columns and 24 lines if the state (L or O) of the day program can change at any desired time of day; if this is not the case, a conductor matrix with a smaller number of lines or columns corresponding to the number of hours in which a change of state may be desired can in some circumstances be sufficient. The unit 36 scans the conductor matrix 42*a* for the day program in steps of one minute and is controlled by the minute pulses on the conductor 32. The switching times or the times of a change of state of the day program T are defined in the conductor matrix 42*a* in the form of junctions, such as the junction 50, in accordance with the hour and minute, so that the programming unit 36 produces a pulse while scanning the conductor matrix 42*a* whenever the day program is to have a change of state. The pulse so produced drives a bistable element (not shown) in the unit 36, the day program T being tapped off the output of the bistable element by means of an output conductor 38. Since matrix scanning circuits and bistable elements are known, it is not necessary to describe the construction of the programming unit 36 in detail because any expert can construct such a unit on the basis of its function described above. It will be understood that the day program can be divided in intervals other than one minute, but it will then be necessary to scan at a frequency other than that corresponding to a one minute pulse. The scanning frequency must of course correspond to the subdivision of the program or the program medium.

The conductor matrix 42*b* for the set time program S could be constructed in the same manner as the conductor matrix 42*a*, but a subdivision of a grading coarser than that of a one minute graduation is in some circumstances sufficient for the set time program, so that the conductor matrix can be made smaller. By scanning the conductor matrix 42*b*, pulses are given at the times at which the set time program has a change of state, which pulses drive a further bistable element (not shown) in the unit 36 in order to produce the states O and L of the set time program.

The conductor 38 with the day program T is connected to one input of an AND circuit 52 whose other input is connected to the conductor 32 which carries the minute pulse. In this manner, only those minute pulses which occur during the L state of the day program pass onto an output conductor 54 of the AND circuit.

The week program W (see FIG. 2(*b*)) is established in a store 56 in order to make due allowance for non-working days. An input conductor 58 of the store 56 is connected via an encoding device 60 to the conductor 34; the purpose of the encoding device 60 is to produce on the input conductor 58 signals which are encoded on the basis of the day pulses and are associated with the different days of the week. The store 56 for the week program could again contain a program medium in the form of a circuit board, but it is advisable to provide a program store which can be readily reprogrammed by manual means. It is most convenient to provide a series of seven manual switches which are successively scanned in the store 56 at 24 hour intervals and whose position corresponds to the week program states associated with the different days of the week.

The output conductor 62 of the store 56 and the output conductor 54 of the AND circuit 52 are connected to the inputs of a second AND circuit 64 so that minute pulses occur on its output conductor 66 only on working days and only when the day program is in the L state.

The set time program S controls a selector switch 68 with two contacts 68*a* and 68*b*, changeover of the selector switch 68 from contact 68*a* to contact 68*b* occurring on the termination of the L state of the set time program. If the end of the set time program coincides with the latest finish time (1900 hours in the illustrated example), it will be necessary for the selector switch 68 to be switched from contact 68*b* to contact 68*a* at the beginning of the state L of the set time program. If the state L of the set time program occurs between the earliest start time and the latest finish time, it will be necessary for the selector switch 68 to be operated at each state of change of the set time program.

The counters 14*a*, 14*b* . . . are constructed so that they can provide incremental operation as well as decremental operation (addition as well as subtraction), i.e. are forward and backward registering, and the inputs and outputs for incremental operation are designated with the numerals 70*a* and 70*b* while inputs and outputs for decremental operation are designated with the numerals 72*a* and 72*b*. All inputs 70*a* are connected to the contact 68*b* while the contact 68*a* is connected to the input 72*a*. The lock switches 16*a*, 16*b* . . . , having contacts 74 and 76, are situated on the output side of the counters 14*a*, 14*b* . . . , the outputs 70*b* being connected to the contacts 74 and the outputs 72*b* being connected to the contacts 76. The other sides of the lock switches can be earthed at 78.

The counters 14*a*, 14*b* . . . are shut down for example on Saturdays, Sundays and holidays or just on Sundays and holidays by the week program W and the AND circuit 64. The counters 14*a*, 14*b* . . . operate decrementally on working days but only until the beginning of the "in-time" of the worker concerned, i.e. until the appropriate lock switch 16*a*, 16*b* . . . is changed over to its contact 74. From this time onwards, the appropriate counter will be shut down until the appropriate lock switch is again changed over or until the selector switch 68 is changed over. If the lock switch is first set to the contact 76, i.e. before the L state of the set time program is completed, the counter will operate decrementally until the selector switch 68 is again changed over to contact 68*b*, whereupon the appropriate counter will be shut down; however, if the selector switch 68 is first changed from contact 68*a* to contact 68*b*, the appropriate counter will operate incrementally until its lock switch is changed over to contact 76, i.e. until the termination of the in-time of the worker concerned.

The counters 14*a*, 14*b* . . . therefore display flexitime balances for each worker and act as means for registering the set working time each day, albeit as a deduction from the in-time worked.

DETAILED DESCRIPTION OF SECOND EMBODIMENT

Figure 5:
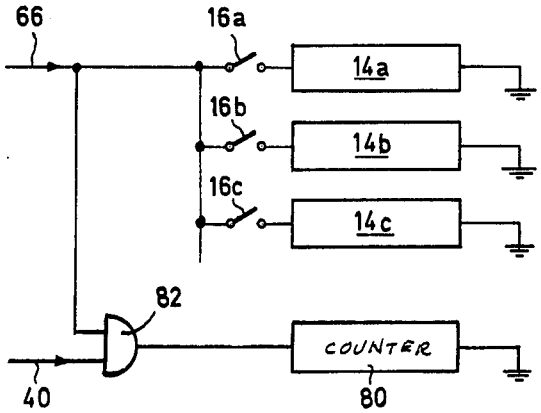
FIG. 5 is a section of the block circuit diagram of a second preferred embodiment of the flexitime recorder of the invention.

Part of a simple embodiment of the flexitime recorder is illustrated in FIG. 5.

The left-hand part of FIG. 5 shows the output conductor 66 of the second AND network 64 and the conductor 40 for the set time program S. Simple counters 14*a*′, 14*b*′ . . . replace the forward and backward registering counters as working time stores, and the function of the counters 14*a*′, 14*b*′. . . is confined to incremental operation (addition). The lock switches 16*a*, 16*b* are therefore illustrated as simple ON-OFF switches. Since minute pulses occur on the output conductor 66 whenever the day program T and the week program W assume the L state, it follows that the content of each counter 14*a*′, 14*b*′ . . . represents the true working time of the worker concerned.

The set working time is stored by a counter unit 80 adapted to operate as a set time counter and also comprising a simple counter (not shown) adapted for incremental operation; the counter unit acts as means for registering the set working time each day. Its input is connected to conductors 66 and 40 which are connected to each other via a third AND circuit 82. In this case, it is also essential that the duration of the L state of the set time program S is equal to the daily set working time plus the break time(s) if the break times occur in the time interval covered by the L state of the set time program S.

The disclosures of our co-pending applications of today's date Ser. No. 491,067 and Ser. No. 491,066 are incorporated herein by reference.

We claim:

1. A flexitime recorder for recording overtime and undertime for a person on flexitime relative to a set working time, comprising:

timing pulse generating means for generating timing pulses;

a plurality of pulse-actuated time store counting means which are capable of incremental and decremental operation on receipt of said timing pulses, each said time store counting means being for a single said person;

display means displaying the time stored by each said time store counting means;

a pluality of switch means actuatable by said persons for controlling said time stored in respective said time store counting means in accordance with the in-time of said persons with whom the individual said time store counting means are associated; and programming means comprising means for storing at least the earliest permitted start time, the latest permitted finish time, the said set time and any break(s), the sum of the said set time and any break(s) defining a set-time period, and means controlling said switch means whereby when, between said earliest start time and said latest finish time, a said switch means is actuated to register in-time, the respective said time store counting means neither increases nor decreases during said set time period and increases outside said set time period, when, between said earliest start time and said latest finish time, a said switch means is not actuated to register in-time, the respective said time store counting means decreases during said set-time period and neither increases nor decreases outside said set-time period, and before said earliest start time and after said latest finish time and during any break(s), whether a said switch means is actuated or not, the respective said time store counting means neither increases nor decreases.

2. The flexitime recorder of claim 1, wherein said programming means further comprises means for storing representations of working days and non-working days, and means responsive to said day representation storing means for blocking delivery of timing pulses to said time store counting means during non-working days.

3. A flexitime recorder comprising a. timing pulse generating means for generating timing pulses;

b. a plurality of pulse-actuated time store counting means for counting said pulses, said counting means being capable of incremental and decremental operation;

c. a plurality of switch means for controlling the time registered in respective said time store counting means in accordance with the in-time of persons with whom the individual time store counting means are associated;

d. programming means for preventing said time store counting means registering in-time outside predetermined periods, comprising means for storing at least the earliest permitted start time, the latest permitted finish time, the set working-time each day and any break(s), the sum of said set-time plus any break(s) defining a set-time period, and means controlling said switch means, whereby when, between said earliest start time and said latest finish time, a said switch means is actuated to register in-time, the respective said time store counting means neither increases nor decreases during said set-time period, and increases outside said set-time period, when, between said earliest start time and said latest finish time, a said switch means is not actuated to register in-time, the respective said time store counting means decreases during said set-time, and neither increases nor decreases outside said set-time period, and before said earliest start time and after said latest finish time and during any break(s), whether a said switch means is actuated or not, the respective said time store counting means neither increases nor decreases.

4. The flexitime recorder of claim 3, wherein said programming means comprises at least a first gate means between said time store counting means and said timing pulse generating means, for suppressing transmission of said timing pulses, said gate means being controlled in accordance with said earliest start time, said latest finish time and any said break(s).

5. The flexitime recorder of claim 4, wherein said switch means are first change-over switches and said programming means comprises at least one further change-over switch, each said time store counting means being associated with a said first change-over switch and a said further change-over switch for changing over from incremental to decremental operation and vice versa, said further change-over switch being controlled to change over at the beginning and end of said set time.

6. The flexitime recorder of claim 3, wherein said switch means are first change-over switches and said programming means comprises at least one further change-over switch, each said time store counting means being associated with a said first change-over switch and a said further change-over switch for changing over from incremental to decremental operation and vice versa, said further change-over switch being controlled to change over at the beginning and end of said set time.

7. The flexitime recorder of claim 6, wherein there is a single said further change-over switch associated with all said time store counting means.

8. The flexitime recorder of claim 3, wherein said programming means further comprises means for storing representation of working days and non-working days, and means responsive to said day representation storing means for blocking delivery of timing pulses to said time store counting means during non-working days.

* * * * *